US010794111B2

(12) United States Patent
DeGraaf

(10) Patent No.: US 10,794,111 B2
(45) **Date of Patent: *Oct. 6, 2020**

(54) PERSONAL PROTECTION EQUIPMENT DISPENSERS

(71) Applicant: Bowman Dispensers, LLC, Caledonia, MI (US)

(72) Inventor: Danté G. DeGraaf, Lake Stevens, WA (US)

(73) Assignee: Bowman Dispensers, LLC, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/513,039

(22) Filed: Jul. 16, 2019

(65) Prior Publication Data

US 2019/0338584 A1 Nov. 7, 2019

Related U.S. Application Data

(63) Continuation of application No. 14/803,982, filed on Jul. 20, 2015, now Pat. No. 10,352,092, which is a continuation-in-part of application No. 14/708,673, filed on May 11, 2015, now abandoned.

(60) Provisional application No. 61/991,751, filed on May 12, 2014.

(51) Int. Cl.

| | |
|---|---|
| ***A47B 67/00*** | (2006.01) |
| ***E06B 5/00*** | (2006.01) |
| ***A47F 3/06*** | (2006.01) |
| ***A47B 81/00*** | (2006.01) |
| ***E04F 19/08*** | (2006.01) |
| *A47F 3/02* | (2006.01) |

(52) U.S. Cl.

CPC ..... *E06B 5/006* (2013.01); *A47B 67/00* (2013.01); *A47B 81/00* (2013.01); *A47F 3/06* (2013.01); *E04F 19/08* (2013.01); *A47F 3/02* (2013.01)

(58) Field of Classification Search

CPC ..... A47B 67/00; A47B 67/02; A47B 67/04; A47B 81/00; A47B 96/00; E06B 5/00; E06B 5/006; E06B 7/28; A47F 3/06; E04F 19/08

USPC ..... 312/211, 34.23, 138.1, 209, 321.5, 311, 312/291, 292, 242, 245

See application file for complete search history.

(56) References Cited

U.S. PATENT DOCUMENTS

| | | | | | |
|---|---|---|---|---|---|
| 4,408,811 | A | * | 10/1983 | Richardson | A47K 10/24 312/138.1 |
| 5,255,971 | A | * | 10/1993 | Aisley | A47B 67/02 312/242 |
| 5,405,196 | A | * | 4/1995 | Shoup | A47B 57/42 248/488 |
| 5,484,196 | A | * | 1/1996 | Kim | A47B 57/06 211/90.01 |

(Continued)

*Primary Examiner* — James O Hansen
(74) *Attorney, Agent, or Firm* — Varnum LLP

(57) ABSTRACT

The present invention generally relates to modular recessed dispensers for holding consumable products such as, but not limited to, disposable latex gloves, gowns, masks that may be contained within a consumables box. In one embodiment, the modular recessed dispensers include replaceable doors or front panels and adjustable shelves and dividers that may be quickly reconfigured to cooperate with the replaced door. The modular recessed dispensers may be fully recessed or semi-recessed into a wall or other structure.

10 Claims, 4 Drawing Sheets

(56) References Cited

U.S. PATENT DOCUMENTS

| | | | | | |
|---|---|---|---|---|---|
| 5,528,810 | A * | 6/1996 | Eddy | B67D 3/00 | 29/401.1 |
| 5,562,163 | A * | 10/1996 | Sartain | A62C 35/20 | 169/51 |
| 5,624,170 | A * | 4/1997 | Hasty | A47B 96/00 | 16/382 |
| 6,089,685 | A * | 7/2000 | Ryan | A47B 67/04 | 312/291 |
| 6,296,181 | B1 * | 10/2001 | Noblet | A47G 29/1201 | 232/24 |
| 6,913,369 | B2 * | 7/2005 | Chadwick | B28B 7/346 | 362/147 |
| 7,762,635 | B2 * | 7/2010 | Spoljaric | A61F 17/00 | 312/245 |
| 8,424,982 | B1 * | 4/2013 | Schwartz | A47B 67/02 | 312/227 |
| 2004/0263029 | A1 * | 12/2004 | Scholefield | A47G 29/141 | 312/242 |
| 2006/0119235 | A1 * | 6/2006 | Aisley | A47B 47/00 | 312/242 |
| 2006/0243618 | A1 * | 11/2006 | Brown | A61M 5/3205 | 206/366 |
| 2011/0115351 | A1 * | 5/2011 | McManic | A47B 45/00 | 312/270.1 |
| 2011/0279001 | A1 * | 11/2011 | Peters | A47B 67/00 | 312/209 |
| 2012/0169196 | A1 * | 7/2012 | Marchetti | E06B 3/721 | 312/265.6 |
| 2015/0182076 | A1 * | 7/2015 | Berke | A47K 3/281 | 312/209 |
| 2015/0374121 | A1 * | 12/2015 | Wood | A47B 67/02 | 312/242 |

* cited by examiner

PERSONAL PROTECTION EQUIPMENT DISPENSERS

RELATED APPLICATIONS

This application, U.S. patent application Ser. No. 16/513,039 filed Jul. 16, 2019 is a continuation of U.S. patent application Ser. No. 14/803,982 filed Jul. 20, 2015, now U.S. Pat. No. 10,352,092 which issued Jul. 16, 2019.

U.S. patent application Ser. No. 14/803,982 is a continuation-in-part of U.S. patent application Ser. No. 14/708,673 filed May 11, 2015, now abandoned.

U.S. patent application Ser. No. 14/708,673 claims priority from U.S. Provisional Application Ser. No. 61/991,751 filed May 12, 2014.

The contents of all related applications are incorporated herein by reference.

TECHNICAL FIELD

The present invention generally relates to personal protection equipment (PPE) dispensers for organizing and dispensing consumable goods such as, but not limited to, gloves, facemasks, gowns, wipes, and pads for industries such as, but not limited to, medical, healthcare, education, foodservice, automotive, and industrial, and more specifically relates to modular PPE dispensers recessed or semi-recessed into a wall or other structure.

SUMMARY

The present invention generally relates to modular PPE dispensers recessed or semi-recessed into a wall or other structure (hereinafter referred to as a "modular recessed dispenser"), and where the modular recessed dispenser is configured to hold consumables boxes containing consumable products such as, but not limited to, disposable latex gloves, facemasks, gowns, wipes, and pads for industries such as, but not limited to, medical, healthcare, education, foodservice, automotive, and industrial.

The present invention may be embodied as a dispenser for dispensing consumable objects comprising a dispenser body, a dispenser frame, first and second shelf structures, and first and second doors. The dispenser body defines a predetermined configuration of mounting structures. The first shelf structure is adapted to be arranged in a first shelf configuration relative the dispenser body, while the second shelf structure is adapted to be arranged in a second shelf configuration relative to the dispenser body. The first door defines at least one first cutout defining a first cutout configuration. The first cutout configuration is configured to cooperate with the first shelf structure in the first shelf configuration to allow access to consumables stored on the first shelf structure in the first shelf configuration. The first cutout configuration is predetermined relative to the first shelf configuration such that, when the first door is rotatably attached to the dispenser frame with the first shelf structure in the first shelf configuration, consumable objects supported by the first shelf structure may be accessed through the at least one first cutout defining the first cutout configuration. The second door defines at least one second cutout defining a second cutout configuration. The at least one second cutout in the second door is configured to cooperate with the second shelf structure in the second shelf configuration to allow access to consumables stored on the second shelf structure in the second shelf configuration. The second cutout configuration is predetermined relative to the second shelf configuration such that, when the second door is rotatably attached to the dispenser frame with the second shelf structure in the second shelf configuration, consumable objects supported by the second shelf structure may be accessed through the at least one second cutout defining the second cutout configuration. The first cutout configuration is different from the second cutout configuration. The first shelf configuration is different from the second cutout configuration. The dispenser may be configured in a first configuration in which the first door is supported by the dispenser body to allow the first door to be rotated between loading and dispensing configurations relative to the dispenser body and the first shelf assembly is arranged in the first shelf configuration relative to the dispenser body and in a second configuration in which the second door is supported by the dispenser body to allow the second door to be rotated between loading and dispensing configurations relative to the dispenser body and the second shelf assembly is arranged in the second shelf configuration relative to the dispenser body.

The present invention may also be embodied as a method of dispensing consumable objects comprising the following steps. A dispenser body, a dispenser frame, first and second shelf structures, and first and second doors are provided. The dispenser body a predetermined configuration of mounting structures. The first shelf structure is adapted to be arranged in a first shelf configuration relative the dispenser body. The second shelf structure is adapted to be arranged in a second shelf configuration relative to the dispenser body, where the first shelf configuration is different from the second cutout configuration. The first door defines at least one first cutout defining a first cutout configuration. The first cutout configuration is configured to cooperate with the first shelf structure in the first shelf configuration to allow access to consumables stored on the first shelf structure in the first shelf configuration. The second door defines at least one second cutout defining a second cutout configuration. The first cutout configuration is predetermined relative to the first shelf configuration such that, when the first door is rotatably attached to the dispenser frame with the first shelf structure in the first shelf configuration, consumable objects supported by the first shelf structure may be accessed through the at least one first cutout defining the first cutout configuration. The at least one second cutout in the second door is configured to cooperate with the second shelf structure in the second shelf configuration to allow access to consumables stored on the second shelf structure in the second shelf configuration, where the first cutout configuration is different from the second cutout configuration, where the second cutout configuration is predetermined relative to the second shelf configuration such that, when the second door is rotatably attached to the dispenser frame with the second shelf structure in the second shelf configuration, consumable objects supported by the second shelf structure may be accessed through the at least one second cutout defining the second cutout configuration. The first set of consumable objects is dispensed by arranging the first shelf assembly in the first shelf configuration relative to the dispenser body and supporting the first door on the dispenser body to allow the first door to be rotated between loading and dispensing configurations relative to the dispenser body. The second set of consumable objects is dispensed by arranging the second shelf assembly in the second shelf configuration relative to the dispenser body and supporting the second door by the dispenser body to allow the second door to be rotated between loading and dispensing configurations relative to the dispenser body

BRIEF DESCRIPTION OF THE DRAWINGS

In the drawings, identical reference numbers identify similar elements or acts. The sizes and relative positions of elements in the drawings may not be necessarily drawn to scale. For example, the shapes of various elements and angles may not be drawn to scale, and some of these elements may be arbitrarily enlarged or positioned to improve drawing legibility. Preferred and alternative embodiments of the present invention are described in detail below with reference to the following drawings.

DETAILED DESCRIPTION

In the following description, certain specific details are set forth in order to provide a thorough understanding of various embodiments of the invention. However, one skilled in the art will understand that the invention may be practiced without these details. In other instances, well-known structures associated with dispensers and organizers for consumable goods, assemblies and subassemblies of the same, and methods of using, assembling and installing any of the above have not necessarily been shown or described in detail to avoid unnecessarily obscuring descriptions of the embodiments of the invention.

The present invention generally relates to modular PPE dispensers recessed into a wall or other structure (hereinafter referred to as a "modular recessed dispenser"), and where the modular recessed dispenser is configured to hold consumables boxes containing consumable products such as, but not limited to, disposable latex gloves, facemasks, gowns, wipes, and pads for industries such as, but not limited to, medical, healthcare, education, foodservice, automotive, and industrial. Consumable products are generally products that are used once and then discarded, but consumable products may also include products that are reusable and replaceable into the modular recessed dispenser after the product has been extracted therefrom. It is understood that the term "recessed" should be broadly interpreted to mean fully recessed, partially recessed or semi-recessed for the purposes of the present description. In one embodiment, modular recessed dispenser is configured to be recessed into new or existing mountable structure, including but not limited to walls, doors and cabinetry. The modular recessed dispenser may include a hinged door with quick release hinges, interchangeable adjustable shelves and dividers, and a replaceable door or front panel. The shelving and door panel are modular in the sense they permit someone to customize and reconfigure the modular recessed dispenser for completely different uses without necessitating any remodeling or demolition of the mountable structure.

Figure 1:
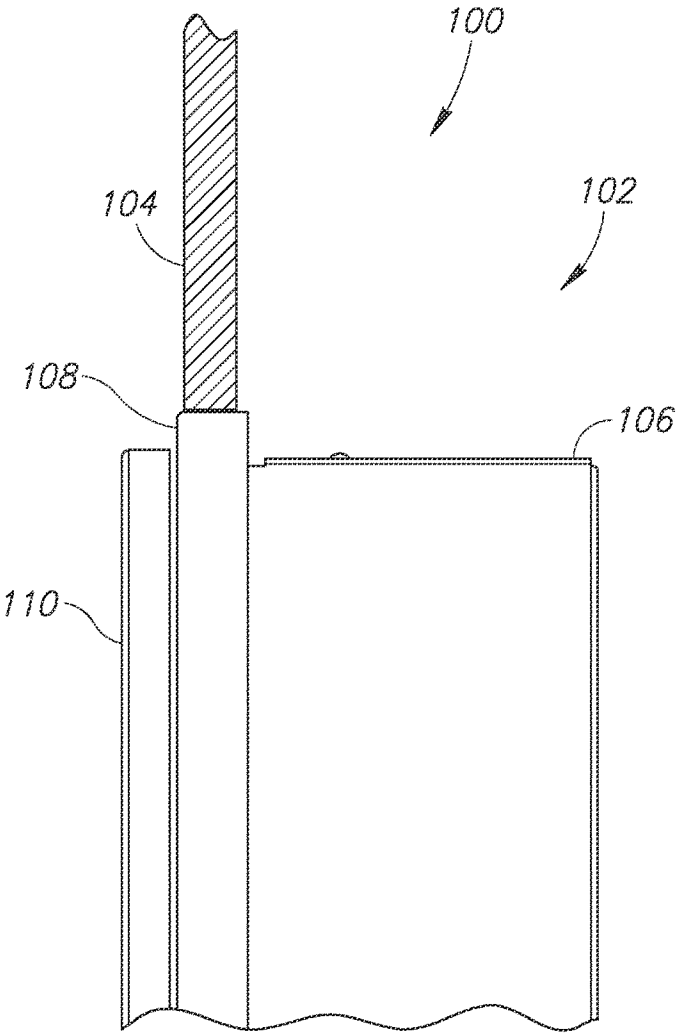
FIG. 1 is a cross-sectional view of a modular recessed dispenser according to an embodiment of the present invention.

FIG. 1 shows a first installation 100 in which a modular recessed dispenser 102 is fully recessed into a structure 104. The modular recessed dispenser 102 includes a body 106 and a frame 108 in which the latter is attached to and aligned within an opening of the structure 104. The modular recessed dispenser 102 further includes a door or front panel 110, which will be described in more detail below.

Figure 2:
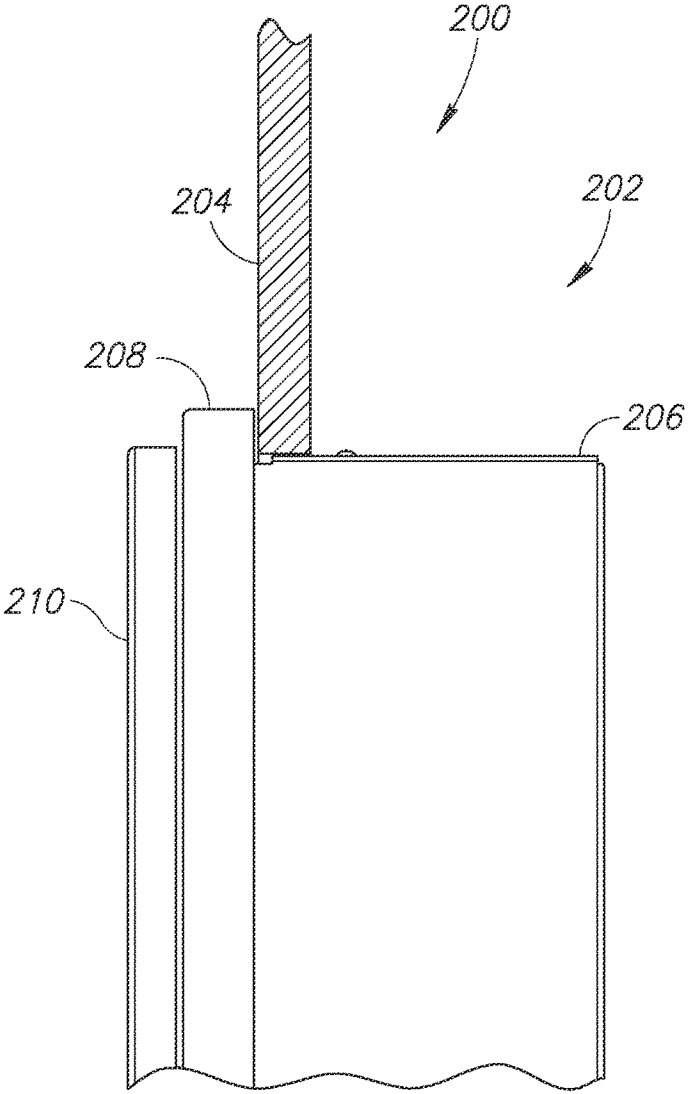
FIG. 2 is a cross-sectional view of a modular semi-recessed dispenser according to another embodiment of the present invention.

FIG. 2 shows a first installation 200 in which a modular recessed dispenser 202 is partially or semi-recessed into a structure 204. The modular recessed dispenser 202 includes a body 206 and a frame 208, in which the latter abuts an outer surface perimeter area that defines an opening of the structure 204. The modular recessed dispenser 202 may also include a door or front panel 210.

Figure 3:
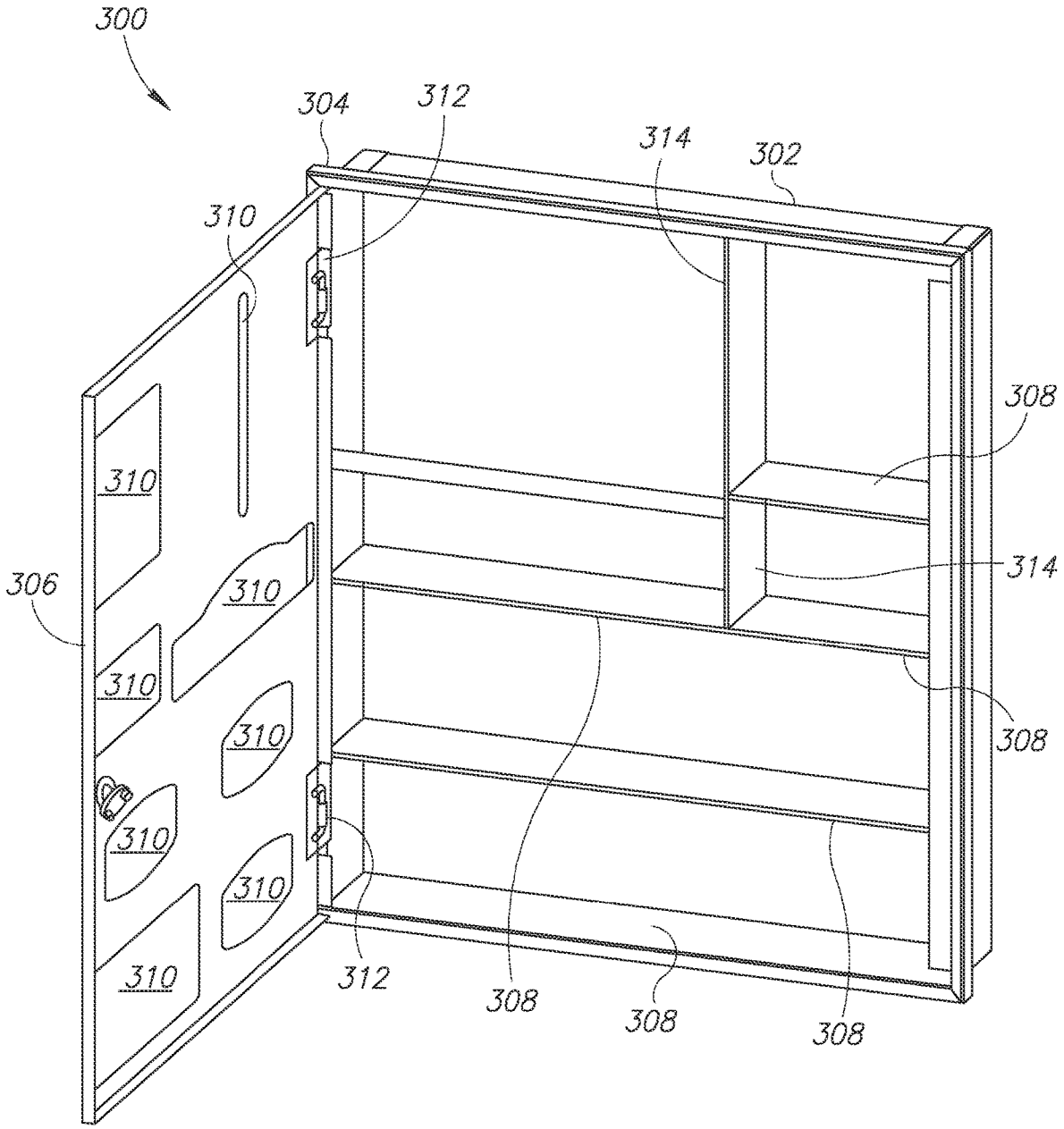
FIG. 3 is a top, front, left perspective view showing a modular recessed dispenser according to another embodiment of the present invention.

FIG. 3 shows a modular recessed dispenser 300 having a body 302, a frame 304 and a door 306 according to another embodiment of the present invention. The frame 304 is coupled to or formed integrally with the body 302 and one or both may be recessed in a structure (not shown). The body 302 includes a plurality of shelves 308 that may be arranged in a variety of ways to cooperate and/or sufficiently align with consumable cutouts 310 formed in the door 306.

In a preferred embodiment, the door 306 includes releasable hinges 312, which may take the form of quick release hinges. The door 306 may be removed and replaced with a different door having different shaped cutouts, similar cutouts arranged in a different pattern or some combination thereof. Likewise, the shelves 308 and dividers 314 may be adjusted, replaced or re-arranged to cooperate with the different door, thus making the dispenser 300 modular in the sense that the body 302 and the frame 304 may remain in situ while the other components of the dispenser 300 are reconfigured. The modularity of the door 306, the shelves 308 and the dividers 314 may advantageously minimize or eliminate remodeling, demolition or re-shaping of the opening in the structure (not shown).

Figure 4:
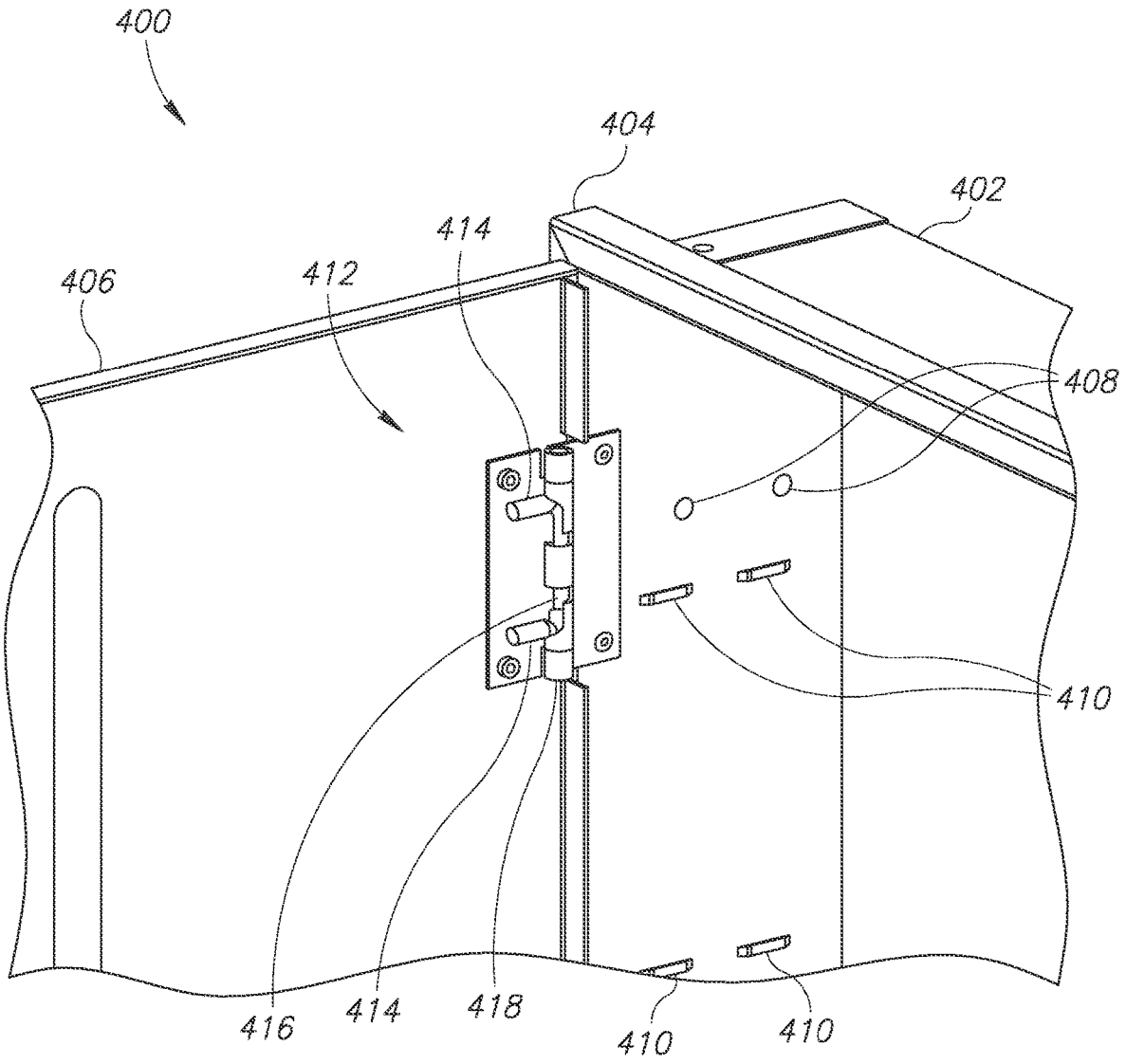
FIG. 4 is a top, front, left perspective and close-up view showing a modular recessed dispenser with releasable hinges according to another embodiment of the present invention.

FIG. 4 shows a modular recessed dispenser 400 having a body 402, a frame 404 and a door 406 according to another embodiment of the present invention. The body 402 includes mounting holes 408 and adjustable shelving supports 410. The door 406 is rotationally coupled to the frame 404 with a quick release hinge assembly 412. In one embodiment, the hinge assembly 412 includes arms 414 coupled to a spindle 416, which is at least partially received within a sleeve 418. Pinching the arms 414 together allows the spindle 416 to be quickly released from the sleeve 418 and the door 406 to be removed and replaced.

Figure 5:
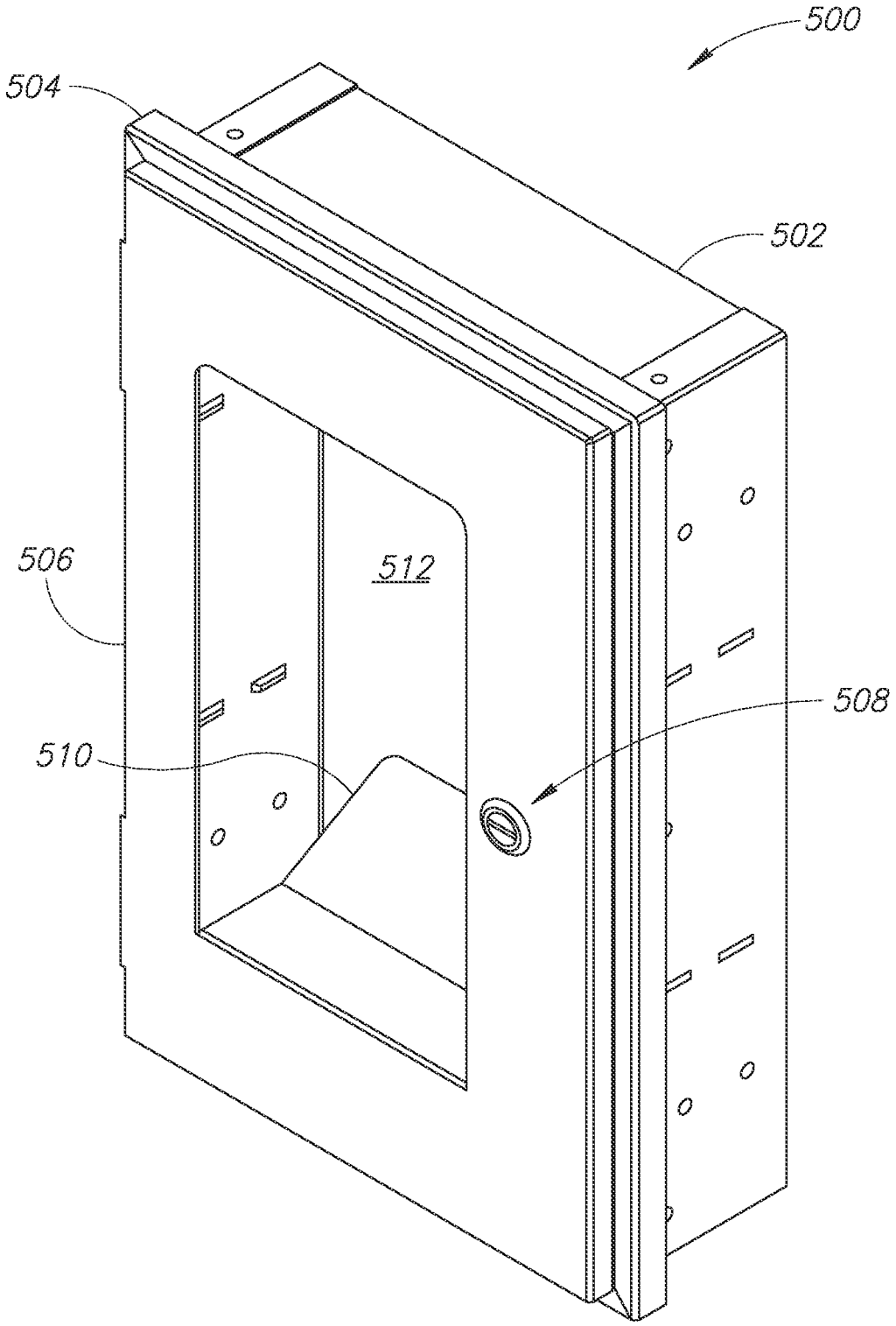
FIG. 5 is a top, front, right perspective view showing a lockable modular recessed dispenser according to another embodiment of the present invention.

FIG. 5 shows a modular recessed dispenser 500 having a body 502, a frame 504 and a door 506 according to another embodiment of the present invention. In the illustrated embodiment, the door 506 includes a lock 508 to secure the door 506 to the frame 504, the body 502 or both. In another embodiment, the lock 508 may be replaced with a latch or both a lock and a latch may be included in the assembly of the door. Although the lock is shown as a standard key-type lock, it is appreciated that the lock may be a digital, magnetic or electronic-type lock. In addition, the body 502 may include a cantilevered shelf 510 configured to biasly urge consumable products (e.g., a box containing medical gowns) toward an opening 512 in the door 506.

The modular recessed dispensers described herein may have hinged doors with or without locks. While the modular recessed dispensers have been described herein with regards to a medical or healthcare application, it is appreciated that such dispensers may be used in a variety of other applications such as, but not limited to, a medicine dispenser, a janitorial supply dispenser, a first aid or safety product dispenser, a tool dispenser, an art supply dispenser, a food item dispenser (e.g., spices, pantry items, foil, plastic wrap, waxed paper, etc.), a sewing item dispenser, and an educational item dispenser (e.g., teacher and/or student supply dispenser locatable in a classroom or school hallway).

Further, the doors may be made from a variety of materials to include, but not limited to, reflective (e.g., mirror), white board, chalkboard, corkboard, magnetic, stainless steel, powder-coated, laminated, composite, plastic, or glass.

The various embodiments described above can be combined to provide further embodiments. All of the above U.S. patents, patent applications and publications referred to in this specification are incorporated herein by reference. Aspects can be modified, if necessary, to employ devices, features, and concepts of the various patents, applications and publications to provide yet further embodiments.

These and other changes can be made in light of the above detailed description. In general, in the following claims, the terms used should not be construed to limit the invention to the specific embodiments disclosed in the specification and the claims, but should be construed to include all types of dispensers, organizers and methods of making and installing the same that operate in accordance with the claims. Accordingly, the invention is not limited by the disclosure, but instead its scope is to be determined entirely by the following claims.

What is claimed is:

1. A dispenser for dispensing consumable objects comprising:

a dispenser body defining a predetermined configuration of mounting structures;

a dispenser frame;

a first shelf structure adapted to be arranged in a first shelf configuration relative the dispenser body;

a second shelf structure adapted to be arranged in a second shelf configuration relative to the dispenser body;

a first door defining at least one first cutout defining a first cutout configuration, where the first cutout configuration is configured to cooperate with the first shelf structure in the first shelf configuration to allow access to consumables stored on the first shelf structure in the first shelf configuration, wherein the first cutout configuration is predetermined relative to the first shelf configuration such that, when the first door is rotatably attached to the dispenser frame with the first shelf structure in the first shelf configuration, consumable objects supported by the first shelf structure may be accessed through the at least one first cutout defining the first cutout configuration;

a second door defining at least one second cutout defining a second cutout configuration, where the at least one second cutout in the second door is configured to cooperate with the second shelf structure in the second shelf configuration to allow access to consumables stored on the second shelf structure in the second shelf configuration, where the second cutout configuration is predetermined relative to the second shelf configuration such that, when the second door is rotatably attached to the dispenser frame with the second shelf structure in the second shelf configuration, consumable objects supported by the second shelf structure may be accessed through the at least one second cutout defining the second cutout configuration; wherein the first cutout configuration is different from the second cutout configuration;

the first shelf configuration is different from the second cutout configuration; wherein the dispenser may be configured in a first configuration in which the dispenser body supports only the first door and the first shelf assembly, where the dispenser body supports the first door such that the first door may be rotated between a first door loading configuration and a first door dispensing configuration relative to the dispenser body, the dispenser body supports the first shelf assembly in the first shelf configuration, with the dispenser in the first configuration and the first door in the first door loading configuration, consumable objects may be arranged on the first shelf structure, and with the dispenser in the first configuration and the first door in the first door dispensing configuration, consumable objects supported by the first shelf structure may be removed from the dispenser through the at least one first cutout in the first door, and in a second configuration in which the dispenser body supports only the second door and the second shelf assembly, where the dispenser body supports the second door such that the second door may be rotated between a second door loading configuration and a second door dispensing configuration relative to the dispenser body, the dispenser boy supports the second shelf assembly in the second shelf configuration, with the dispenser in the second configuration and second first door in the second door loading configuration, consumable objects may be arranged on the second shelf structure, and with the dispenser in the second configuration and the second door in the second door dispensing configuration, consumable objects supported by the first shelf structure may be removed from the dispenser through the at least one second cutout in the second door.

2. The dispenser of claim 1, further comprising at least one quick release hinge, where the at least one quick release hinge is configured to support:

the first door from the dispenser body in the first configuration; and the second door from the dispenser body in the second configuration.

3. The dispenser of claim 1, wherein the dispenser body and the dispenser frame are both recessed into an opening formed in a structure.

4. The dispenser of claim 3, wherein the dispenser body is recessed into the opening formed in the structure while the dispenser frame abuts an external surface of the structure.

5. The dispenser of claim 1, further comprising:

at least one divider; and the at least one divider is detachably attached to the dispenser body when the dispenser is in the first shelf configuration.

6. A method of dispensing consumable objects comprising the steps of:

providing a dispenser body defining a predetermined configuration of mounting structures;

providing a dispenser frame;

providing a first shelf structure adapted to be arranged in a first shelf configuration relative the dispenser body;

providing a second shelf structure adapted to be arranged in a second shelf configuration relative to the dispenser body, where the first shelf configuration is different from the second shelf configuration;

providing a first door defining at least one first cutout defining a first cutout configuration, where the first cutout configuration is configured to cooperate with the first shelf structure in the first shelf configuration to allow access to consumables stored on the first shelf structure in the first shelf configuration;

providing a second door defining at least one second cutout defining a second cutout configuration, where the first cutout configuration is predetermined relative to the first shelf configuration such that, when the first door is rotatably attached to the dispenser frame with the first shelf structure in the first shelf configuration, consumable objects supported by the first shelf structure may be accessed through the at least one first cutout defining the first cutout configuration;

the at least one second cutout in the second door is configured to cooperate with the second shelf structure in the second shelf configuration to allow access to consumables stored on the second shelf structure in the second shelf configuration, where the first cutout configuration is different from the second cutout configuration, where the second cutout configuration is predetermined relative to the second shelf configuration such that, when the second door is rotatably attached to the dispenser frame with the second shelf structure in the second shelf configuration, consumable objects supported by the second shelf structure may be accessed through the at least one second cutout defining the second cutout configuration;

supporting only the first shelf structure and the first door on the dispenser body in a first configuration to dispense consumable objects by supporting the first shelf assembly on the dispenser body in the first shelf configuration, supporting the first door on the dispenser body to allow the first door to be rotated between a first door loading configuration and a first door dispensing configuration relative to the dispenser body, with the first door in the first door loading configuration, arranging consumable objects on the first shelf structure, and with the first door in the first door dispensing configuration, removing consumable objects from the dispenser through the at least one first cutout in the first door; and supporting only the second shelf structure and the second door on the dispenser body in a second configuration to dispense consumable objects by supporting the second shelf assembly on the dispenser body in the second shelf configuration, supporting the second door on the dispenser body to allow the second door to be rotated between a second door loading configuration and a second door dispensing configuration relative to the dispenser body, and with the second door in the second door loading configuration, arranging consumable objects on the second shelf structure, and with the second door in the second door dispensing configuration, removing consumable objects from the dispenser through the at least one second cutout in the second door.

7. The method of claim 6, further comprising the step of arranging at least one release hinge to support:

the first door from the dispenser body in the first configuration; and the second door from the dispenser body in the second configuration.

8. The method of claim 6, further comprising the step of arranging the dispenser body and the dispenser frame at least partly within an opening formed in a structure.

9. The method of claim 8, in which the dispenser body is recessed into the opening formed in the structure while the dispenser frame abuts an external surface of the structure.

10. The method of claim 6, further comprising the steps of:

providing at least one divider; and supporting the at least one divider on the dispenser body when the dispenser is in the first shelf configuration.

* * * * *